US009598774B2

(12) United States Patent
Ajdelsztajn et al.

(10) Patent No.: US 9,598,774 B2
(45) Date of Patent: Mar. 21, 2017

(54) COLD SPRAY OF NICKEL-BASE ALLOYS

(75) Inventors: Leonardo Ajdelsztajn, Niskayuna, NY (US); Timothy Hanlon, Glenmont, NY (US)

(73) Assignee: General Electric Corporation, Niskayuna, NY (US)

( * ) Notice: Subject to any disclaimer, the term of this patent is extended or adjusted under 35 U.S.C. 154(b) by 1136 days.

(21) Appl. No.: 13/328,290

(22) Filed: Dec. 16, 2011

(65) Prior Publication Data

US 2013/0153089 A1 Jun. 20, 2013

(51) Int. Cl.
*C23C 24/04* (2006.01)

(52) U.S. Cl.
CPC ..... *C23C 24/04* (2013.01)

(58) Field of Classification Search
CPC ..... C23C 24/04; C23C 24/00; C23C 24/02; C23C 24/08; C23C 24/082; C23C 24/085; C23C 24/087; C22C 19/03; B22F 2301/15
USPC ..... 427/455
See application file for complete search history.

(56) References Cited

U.S. PATENT DOCUMENTS

| | | | |
|---|---|---|---|
| 5,061,324 | A | 10/1991 | Chang |
| 6,755,924 | B2 | 6/2004 | Harrison et al. |
| 7,033,448 | B2 | 4/2006 | Groh et al. |
| 7,654,223 | B2 | 2/2010 | Kim et al. |
| 8,020,509 | B2 | 9/2011 | Calla et al. |
| 8,147,749 | B2 | 4/2012 | Reynolds |
| 2004/0216813 | A1 | 11/2004 | Buergel et al. |
| 2005/0056354 | A1 | 3/2005 | Groh et al. |
| 2006/0121183 | A1 | 6/2006 | DeBiccari et al. |
| 2006/0134454 | A1 | 6/2006 | Sathian |
| 2007/0240793 | A1 | 10/2007 | Mourer et al. |
| 2008/0160332 | A1 | 7/2008 | Dighe et al. |
| 2009/0075110 | A1* | 3/2009 | Kulkarni ..... C22C 19/007 428/548 |
| 2009/0092823 | A1 | 4/2009 | Webb et al. |
| 2010/0008816 | A1 | 1/2010 | Hu |
| 2010/0173087 | A1 | 7/2010 | Calla et al. |
| 2010/0251962 | A1 | 10/2010 | Fukanuma |
| 2011/0052409 | A1 | 3/2011 | Lupulescu et al. |
| 2011/0143039 | A1 | 6/2011 | Jakimov et al. |

FOREIGN PATENT DOCUMENTS

| | | | |
|---|---|---|---|
| CN | 1431336 | A | 7/2003 |
| EP | 787815 | B1 | 10/2001 |
| EP | 2206568 | A2 | 7/2010 |
| JP | S61106757 | A | 5/1986 |
| JP | S61266506 | A | 11/1986 |

(Continued)

OTHER PUBLICATIONS

"Alloy IN-738 Technical Data." INCO—The International Nickel Company, Inc., n.d. Web. May 26, 2015.*

(Continued)

*Primary Examiner* — Jessee Roe
*Assistant Examiner* — Anthony Liang
(74) *Attorney, Agent, or Firm* — Paul J. DiConza

(57) ABSTRACT

Briefly, in one embodiment, a method is disclosed. The method includes introducing a powder feedstock into a cold-spray apparatus, and operating the cold-spray apparatus to deposit the feedstock. The feedstock includes particles including nickel-base alloy having a thermally altered microstructure.

20 Claims, 1 Drawing Sheet

(56) References Cited

FOREIGN PATENT DOCUMENTS

| | | | |
|---|---|---|---|
| JP | H03120350 | A | 5/1991 |
| JP | 2001330542 | A | 11/2001 |
| JP | 2006283186 | A | 10/2006 |
| JP | 2007284792 | A | 11/2007 |
| JP | 2009132964 | A | 6/2009 |
| JP | 2011240314 | A | 12/2011 |
| WO | 2011119147 | A | 9/2011 |

OTHER PUBLICATIONS

Reed, Roger C. "Composition-microstructure Relationships in Nickel Alloys." The Superalloys: Fundamentals and Applications. Cambridge, UK: Cambridge UP, 2006. 34-35.*

O'Brien, Annette. "Chapter 11—Thermal Spraying and Cold Spraying." Welding Handbook. 9th ed. vol. 3.—Welding Processes (Part 2): American Welding Society (AWS), 2007. 396-97.*

Kim et al.,"Fabrication of WC—Co coatings by cold spray deposition", Science Direct, Surface & Coatings Technology, 2005, vol. 191, pp. 335-340.

Kim et al.,"Study on Metal/Diamond Binary Composite Coatings by Cold Spray", Materials Science Forum, 2007,vols. 534-536, pp. 441-444.

Ning et al.,"The effects of powder properties on in-flight particle velocity and deposition process during low pressure cold spray process", Science Direct, Applied Surface Science, 2007, vol. 253, pp. 7449-7455.

Kuroda et al.,"Warm spraying—a novel coating process based on high-velocity impact of solid particles", IOP Publishing, Science and Technology of Advancedmaterials, 2008, vol. 9, 033002, 17 Pages.

Kim et al.,"The Effect of Ni Coating for Diamond on the Metal/Diamond Composite Coatings by Cold Spray Deposition", Thermal Spray 2009: Proceedings of the International Thermal Spray Conference, pp. 285-289.

Yoon et al.,"Dependence of initial powder temperature on impact behaviour of bulk metallic glass in a kinetic spray process", Journal of Physics D: Applied Physics, Apr. 21, 2009, vol. 42 No. 8, 8 Pages.

Ajdelsztajn et al.,"Combustion Cold Spray", Pending U.S. Appl. No. 12/790,170, filed May 28, 2010, 27 Pages.

Yoon et al.,"Formation of coating and tribological behavior of kinetic sprayed Fe-based bulk metallic glass", Journal of Alloys and Compounds, 2011, vol. 509, pp. 347-353.

Kuroda et al.,"Current Status and Future Prospects of Warm Spray Technology", Journal of Thermal Spray Technology, ASM International, Peer Reviewed, Jun. 2011,vol. 20(4), 24 Pages.

Klassen et al.,"Strategies for an Improved Cold Spray System", Institute of materials technology, Downloaded from the Internet<http://www.hsu-hh.de/werkstoffkunde/index.phpbrick_id=ABTBJyyQh79FymEP&action=setlanguage&language=en > on Oct. 14, 2011, 4 Pages.

Search Report and Written Opinion from corresponding EP Application No. 12195194.1-1362 dated Mar. 7, 2013.

Ogawa et al., "Repair of Turbine Blades Using Cold Spray Technique", Advances in Gas Turbine Technology, pp. 499-527, Nov. 4, 2011.

Unofficial English Translation of Chinese Office Action issued in connection with corresponding CN Application No. 201210540808.X on Feb. 14, 2016.

Unofficial English translation of Office Action and Search Report issued in connection with corresponding JP Application No. 2012-267829 on Sep. 20, 2016.

* cited by examiner

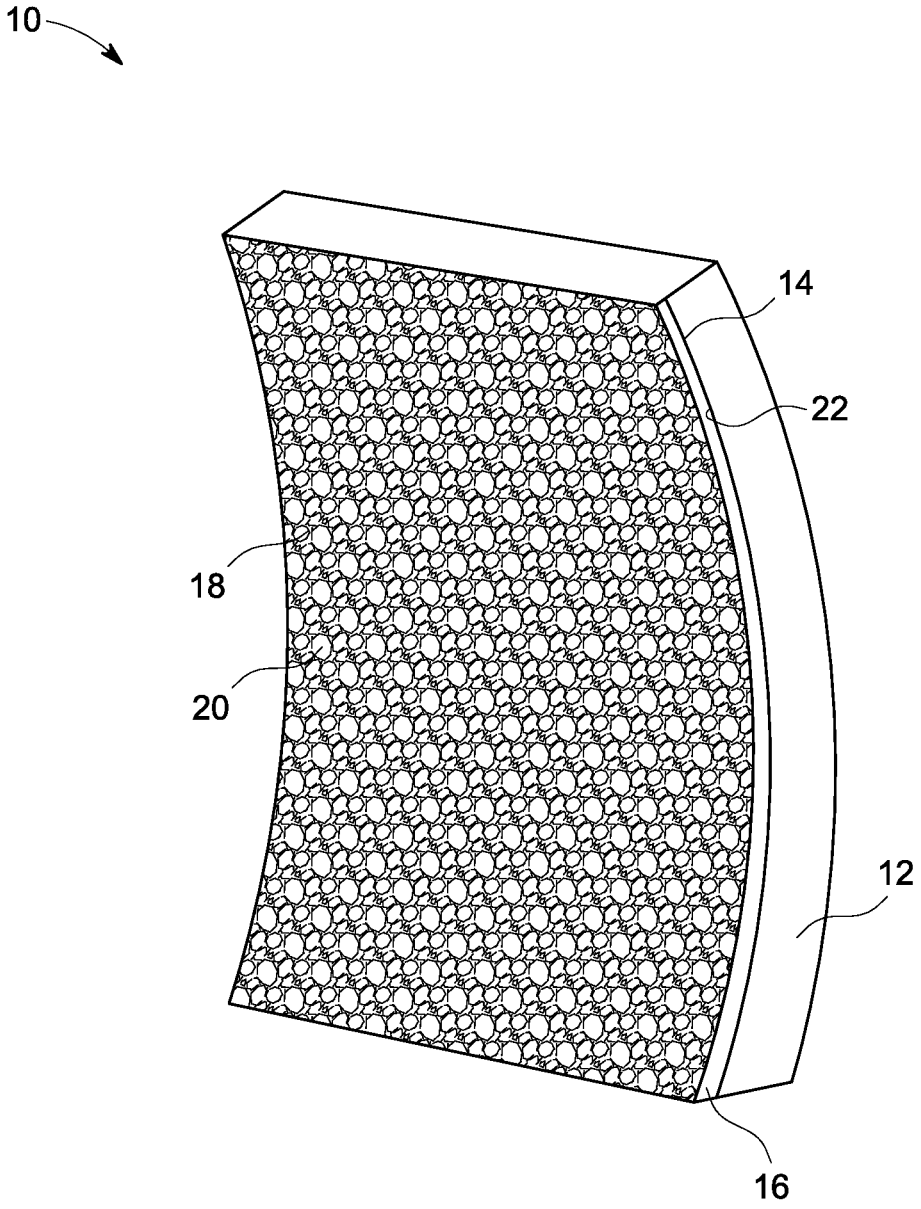
10
14
22
18
20
12
16

COLD SPRAY OF NICKEL-BASE ALLOYS

BACKGROUND

The invention relates generally to cold spray and, in particular, to the methods of cold spraying feedstocks including nickel-base alloys.

Bonded surface layers are desired for many applications including those in which the surfaces experience corrosion, erosion, or high temperature. One method used for producing bonded metallic coatings on substrates is cold spray technology. In cold spray technology (also referred to herein as simply "cold spray"), particles are mixed with a gas and the gas and particles are subsequently accelerated into a supersonic jet, while the gas and particles are maintained at a sufficiently low temperature to prevent melting of the particles. Copper coatings have been deposited using cold spray in which sufficient bonding was achieved to produce bulk-like properties. However, higher temperature materials such as stainless steel, nickel, nickel-based and titanium-based super alloys, are likely to require higher velocities to produce high quality deposits with limitations of conventional cold spray devices. In particular, achieving higher particle and deposit temperatures and/or velocities would be desirable.

In order to attain better properties using higher melting point metals than copper, cold spray equipment is moving towards higher gas temperatures. However, even high temperature nitrogen gas is difficult to accelerate to velocities fast enough to make dense deposits of high-melting point materials such as nickel, iron, or titanium alloys. Therefore, in order to have high enough velocities to make dense deposits of the high-melting point materials, helium gas is favored compared to the conventional nitrogen gas. However, using helium gas for cold spraying is commercially challenging.

Therefore, there is a need for an economical method of making a good quality bonded deposit of high-temperature melting alloys.

BRIEF DESCRIPTION

Briefly, in one embodiment, a method is disclosed. The method includes introducing a powder feedstock into a cold-spray apparatus, and operating the cold-spray apparatus to deposit the feedstock. The feedstock includes particles including a nickel-base alloy having a thermally altered microstructure.

In one embodiment, a method is disclosed. The method includes introducing a powder feedstock into a cold-spray apparatus, and operating the cold-spray apparatus to deposit the feedstock. The feedstock consists essentially of nickel-base alloy particles having a thermally altered microstructure.

DRAWING

These and other features, aspects, and advantages of the present invention will become better understood when the following detailed description is read with reference to the accompanying drawing, wherein:

FIG. 1 illustrates an article with a deposit, according to an embodiment of the invention.

DETAILED DESCRIPTION

Embodiments of the present invention include the apparatus and method for producing dense metal deposit on a substrate from solid state impact deposition with bonded particles using a cold spray device with nickel-base alloy feedstock.

In the following specification and the claims that follow, the singular forms "a", "an" and "the" include plural referents unless the context clearly dictates otherwise.

The term "bonded", as used herein means in contact with and adhered to. "Bonding" may be between the deposited particles and/or between the deposited particles and the substrate. A "deposit" is a bulk or layer on a substrate. In a specific embodiment, the deposit is a coating.

Typical cold spray methods use a spray gun that receives a high pressure gas such as, for example, helium, nitrogen, or air, and a feedstock of deposit material, such as, for example, metals, refractory metals, alloys, or composite materials in powder form. The powder granules are introduced at a high pressure into a gas stream in the spray gun and emitted from a nozzle. The particles are accelerated to a high velocity in the gas stream that may reach a supersonic velocity. The gas stream may be heated. Typically the gases are heated to less than the melting point of the particles to minimize in-flight oxidation and phase changes in the deposited material. As a result of the relatively low deposition temperatures and very high velocities, cold spray processes offer the potential for depositing well-adhering, metallurgically bonded, dense, hard and wear-resistant coatings whose purity depends primarily on the purity of the feedstock powder used.

The powder impacts the substrate at a high velocity. The kinetic energy of the powder causes the powder granules to deform and flatten on impact with the substrate. The flattening promotes a metallurgical, mechanical, or combination of metallurgical and mechanical bond with the substrate and results in a deposit on the substrate. One advantage of cold spraying methods is the negligible to nil phase change or oxidation of particles during flight and high adhesion strength of the bonded particles.

In order to have sufficiently high velocities to make dense deposits of the high melting point materials, an expensive helium (He) gas is normally used instead of nitrogen ($N_2$) gas as nitrogen gas is often difficult to accelerate to velocity fast enough to make dense deposits of high melting point materials such as, for example, nickel (Ni), iron (Fe), or titanium (Ti) alloys, when used in the conventional cold spray methodologies. However, spraying with helium is expensive. Embodiments of the present invention take advantage of benefits conferred by a pre-treatment of the feedstock powder to make it amenable for cold-spraying at less demanding conditions than the conventional helium-based cold spray methods for depositing a coating of high melting point metals and alloys.

Changing some characteristics of the feedstock microstructure and/or morphology to effect reduction of particle strength and/or hardness (relative to such characteristics and properties for particles received after typical powder manufacturing processes) provides a softer particle feedstock be fed to the spray apparatus, allowing a softer material to impact and deform at the substrate and thus forming a dense, high quality deposit. Some embodiments of the disclosed method include a heat-treatment of the feedstock material that changes the material structure and property, making the feedstock amenable for cold-spraying at economically convenient conditions. The disclosed method is different from an in-situ or inside-the-spray gun heat-treatment of the feedstock material during or just before spraying out the feedstock. The feedstock material used herein receives its heat-treatment and thus changes its microstructure, morphology and/or strength/hardness, even before introduction into the cold spray apparatus. Further, the heat-treatment that is received by the feedstock material in this application is different than what can be applied inside a spray gun apparatus. Prior disclosures of inside-the-spray-gun heat-treatments of the feedstock material are limited in the temperature and time duration of high-temperature treatment of the feedstock material and thereby the microstructure, morphology, and strength/hardness when compared to the heat-treated particles of the present application.

In one embodiment of the cold spray method presented herein, the feedstock material comprises a metal, or a metal alloy. Examples include metals such as nickel, cobalt, titanium, aluminum, zirconium, and copper. Examples of metal alloys include nickel-base alloys, cobalt-base alloys, titanium-base alloys, iron-base alloys, steels, stainless steels, and aluminum-base alloys.

Some of the nickel, iron, cobalt, or titanium-base alloys are used in aviation- and land-based gas turbine engine components and are particularly desirable to be cold-spray deposited to form a dense coating without undue oxidation. Alloys, such as so-called "superalloys" commercially available under such trade names as INCONEL®, INCOLOY®, RENE®, WASPALOY®, UDIMET®, Hastelloy®, and Mar-M™ materials are some of the non-limiting examples that are particularly beneficial to be used for the engine components. INCONEL® is a registered trademark of Huntington Alloys Corporation of Huntington, W. Va. INCOLOY® is a registered trademark of Inco Alloys International, Inc. of Huntington, W. Va. RENE® is a registered trademark of Teledyne Industries, Inc. of Los Angeles, Calif. WASPALOY® is a trademark of Haynes International, Inc. of Kokomo, Ind. UDIMET® is a registered trademark of Special Metals. Corporation. Hastelloy® is the registered trademark name of Haynes International, Inc. Mar-M™ is a trademark of Martin Marietta. While different feedstock and deposit materials are included in the invention, the application herein is further described in terms of nickel-base alloys as the feedstock material as well as deposit material.

A non-limiting example of a nickel-base alloy is alloy 718, having a specific composition, in weight percent, from about 50 to about 55 percent nickel, from about 17 to about 21 percent chromium, from about 4.75 to about 5.50 percent niobium, from about 2.8 to about 3.3 percent molybdenum, from about 0.65 to about 1.15 percent titanium, from about 0.20 to about 0.80 percent aluminum, 1.0 percent maximum cobalt, and balance iron. Small amounts of other elements such as carbon, manganese, silicon, phosphorus, sulfur, boron, copper, lead, bismuth, and selenium may also be present.

Strengthened nickel-base alloys generally include precipitated phases, such as for example, gamma-prime (γ'), gamma-double prime (γ"), and high-temperature precipitates such as, for example, carbides, oxides, borides, and nitride phases, either singularly or in combination, depending on the alloy composition and heat-treatments conditions of the alloy. In some embodiments, phases such as delta, sigma, eta, mu, and/or laves may also be present.

The precipitate phases such as gamma-prime and gamma-double prime in nickel base alloys are typically dissolved during solution heat-treatments, and re-precipitate during cooling from the solution temperature and during subsequent aging heat-treatments. The result is a distribution of gamma-prime and/or gamma-double prime secondary phases in a nickel-alloy matrix. High-temperature precipitates such as carbides, oxides, borides, and nitride phases may not typically dissolve during solution heat-treatments and may thus remain as precipitates even after solution heat-treatment of the alloys. The general steps involved in these treatments along with different expected precipitations at each steps are detailed below.

In typical precipitate hardened nickel alloys, the alloys are initially given a solution treatment (or, in the parlance of the art, the alloys are initially "solutioned" or "solutionized"), wherein the alloys are heated above the solvus temperature of the precipitates. The precipitates referred herein may be the 'primary', 'secondary', or 'tertiary' precipitates that form during different stages of temperature-treatments rather than the high temperature carbide, oxide, boride, or nitride phases that may be present even above the solvus temperatures of the primary/secondary/tertiary precipitates.

Generally the alloys are quenched after solution treatment forming a supersaturated solid solution phase. In one embodiment, the matrix includes nickel-base gamma (γ) phase. The gamma-phase is a solid solution with a face-centered cubic (fcc) lattice and randomly distributed different species of atoms. In some alloys, where the high temperature precipitate phases are present, the supersaturated solid solution phases may still have the precipitates of those high temperature phases. In one embodiment, in a gamma-prime system like Rene 88® or Waspaloy® for example, the gamma prime may precipitate quickly even during quenching. Typically, alloys in the solutioned state, even where precipitation occurs during quenching, are significantly softer than alloys in the fully processed state, as noted below.

In the third step, the supersaturated solid solution phase is heated below the solvus temperature of the precipitates to produce a finely dispersed precipitate. For example, in a gamma-double prime system, the gamma-double prime phase may largely precipitate during the aging treatment thereby hardening and strengthening the alloy.

Thus, strengthened nickel-base alloys are typically processed by using designed solution heat-treatment methods that dissolve gamma-prime and/or gamma-double prime strengthening phases and then allow the optimum reprecipitation of these phases upon cooling from heat-treatment or after subsequent aging of the solutioned alloys. The cooling rate, and cooling path imposed on nickel-base alloy components, along with the aging temperature and times, and inherent properties of the particular compositions normally influence development of optimum properties in the nickel-base alloys.

In one embodiment of the invention, a method for preparing an article made of a nickel-base alloy deposits strengthened by the presence of gamma-prime and/or gamma-double prime phases is disclosed. The method includes the steps of solution heat-treating a nickel-base alloy powder at a solutionizing temperature above gamma-prime and/or gamma-double prime solvus temperatures of the nickel-base alloys. In one embodiment, the method further includes quenching the nickel-base alloy powders to a temperature less than the gamma-prime and gamma-double prime solvus temperatures. The quenching may be carried out in one step or in multiple steps. Normal air quenching or water, oil, or molten salt bath quenching methods may be used for the quenching.

In one embodiment of the invention, the solution heat-treated and quenched powders are used as at least a part of the feedstock for the cold-spray deposition. The solution treatment is normally performed at temperatures sufficiently high to partially or fully dissolve the strengthening phases, typically on the order of 900° C. to 1300° C. for nickel-base alloys, typically for a duration of 1 hour to 10 hours. This solution heat-treatment and quenching alters the microstructure of the nickel-base alloys and the resultant particles typically have a thermally altered microstructure.

In one embodiment, the altered microstructure of the nickel-base alloy refers to the changed microstructure from the atomized state of the nickel-base alloy prior to a heat-treatment to the atomized powder. A thermally altered microstructure, then, refers to a microstructure that has microstructural features that differ from the features of the powder prior to heat-treatment as a result of having been exposed to heat-treatment. Non-limiting examples of such features include grain size; grain morphology; precipitate size, morphology, and size distribution; and degree of chemical segregation. In one embodiment, the materials are thermally processed using a heat-treatment that results in the material being softer than it was prior to the treatment. In one embodiment, the atomized nickel-base alloys are heat-treated to a temperature of at least half the melting point of the nickel-base alloy for a duration of at least 5 minutes to develop a thermally altered microstructure. The melting temperature as defined herein means the incipient melting point of the alloy, wherein a liquid phase begins to appear under equilibrium conditions.

In one embodiment, the quenched powders, before receiving further aging heat-treatment, are in a single phase supersaturated solution phase, without having the presence of any of the gamma-prime or gamma-double prime phase precipitates. In one embodiment, the quenched powders comprise substantially solutioned microstructure. As used herein the "substantially solutioned microstructure" means that the powder particles are in a solution-treated state having a microstructure characteristic of material having been through a solution heat-treatment and rapid quench. In most embodiments, high temperature phases such as carbides, oxides, nitrides, and borides, if present in the powder prior to heat-treatment, persist within the matrix after heat-treatment. In one embodiment, a solution treatment is a heat-treatment to a temperature where thermodynamics favor existence as a single phase, for a time sufficient to establish equilibrium conditions.

In one embodiment, the solution treated and quenched state includes matrix phase and precipitate phases that formed during quenching without undergoing any aging treatment to form post-primary fine precipitates that aid in increasing strengthening. In one embodiment, a matrix phase of gamma nickel and gamma-prime primary precipitate is present in the solution treated and quenched nickel-base alloy. In one embodiment, the nickel-base alloys are subjected to slow-quenching from the solution temperature. Cooling the materials while leaving them in the heat treatment furnace (a practice known in the art as "furnace cooling") is a typical method of slow-quenching in these alloys systems. The slow-quenched alloys materials typically have coarser grains precipitates and reduced strength compared to conventionally aged alloys of similar composition.

In one embodiment, the feedstock particles used for the cold spray include a nickel base alloy. In one embodiment, the nickel-base alloy includes feedstock particles having at least about 40% of nickel by weight.

In one embodiment, the microstructure of the solution heat-treated and quenched feedstock powders include coarse grains. As used herein, "grains" are individual crystals and the grain size refers to size of crystals within a given particle.

In one embodiment, the strength of the nickel-base alloys is reduced by the solution heat-treatment, relative to the powders before subjecting to the heat-treatment, due to grain coarsening and/or precipitate dissolution associated with solution heat-treating. In one embodiment, the particles of the feedstock materials have average grain size ranging from about 1 μm to about 20 μm. Feedstock materials with different particle sizes can be used in the cold spray method presented herein to form strong and dense deposits. In one embodiment, the particles used for the feedstock have a median size in the range from about 1 micron to about 100 microns. In a further embodiment, the particles have a median size in the range from about 5 microns to about 50 microns. In one embodiment, the particles obtained after solution heat-treatment and quenching have a face-centered cubic crystal structure.

As discussed previously, in one embodiment of the cold spray method presented herein, the feedstock material does not melt at the time of spraying. In one embodiment, the melting point of the feedstock material is above the temperature experienced by the feedstock material during spraying. In a further embodiment, the temperature experienced by the feedstock material is below about 0.9 times the melting point of the feedstock material.

In one embodiment of the invention, a carrier gas is used for carrying the feedstock materials for depositing. Because of the change in microstructure and decreased strength/hardness of the solution heat-treated nickel-base alloys, it is not necessary to use a helium gas for obtaining a dense deposit of the nickel-base alloys on the article, or to use a very high temperature of the carrier gas or high velocity of the feedstock material. Therefore, in one embodiment of the invention, a carrier gas having at least 50 volume % of nitrogen is used for the cold spray. In one embodiment, the carrier gas includes at least 75 volume % of nitrogen. In one embodiment, the carrier gas consists essentially of nitrogen. In one embodiment, the carrier gas used for depositing is essentially free of helium. In one embodiment, the carrier gas temperature is in the range from about 20° C. to about 1200° C. In general, in the cold spray process, an impact critical velocity of the feedstock material is defined as below which the particle adhesion to the substrate is not useful for the intended application. The critical velocity of the feedstock material may depend on the feedstock particles and the substrate nature and properties. In one embodiment, operating the cold spray device used herein comprises accelerating the feedstock to a velocity in the range from about 500 m/s to about 1100 m/s.

In one embodiment, the article on which the deposit is formed is prepared for receiving the deposit. Preparing the article surface for the cold spray may include cleaning and/or degreasing the surface. In one embodiment, a prepared region of the article surface is formed by removing the existing material or layer such as an oxide layer for example, from the surface of the article so that the deposit formed by directing the feedstock material through cold spray is bonded to the article.

In one embodiment of the invention, an article is provided. The article may be of any operable shape, size, and configuration. Examples of articles of interest include areas of components of gas turbine engines such as seals and flanges, as well other types of articles. The article 10, as shown in FIG. 1 for example, is formed when a deposit is formed on a substrate 12 of the article 10. The substrate 12 has a depositing surface 14. The deposit 16 is formed on the surface 14 of article 10. The deposit 16 has a plurality of feedstock particles 18 bonded along their prior particle boundaries 20. A surface of contact between the deposited material 16 and the substrate 12 surface 14 is a bond line 22.

In one embodiment, the article 10 and/or the deposit 16 are heat-treated after the cold spray. Annealing or aging heat-treatments are used to precipitate the gamma prime or gamma-double prime phases in the nickel-base alloy matrix. In one embodiment, the temperature of the aging is in the range from about 300° C. to about 1000° C. In one embodiment, the temperature of the aging is in the range of about 400° C. to about 850° C. In one embodiment, the precipitates so formed are less than about 80% by volume of the deposit. In one embodiment, the precipitated strengthening phases are in the range from about 20 volume % to about 55 volume % of the deposit.

The heat-treatment may cause the deposit material 16 to interdiffuse to some degree with the substrate 12 material of the article 10. In one embodiment, the deposit 16 is solution heat-treated, quenched, and aged to precipitate a desirable distribution of strengthening phases. In one embodiment, the deposit 16 of article 10 has a density greater than about 95% of theoretical density of the deposit material. In a further embodiment, the deposit 16 has a density greater than about 99% of theoretical density.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method comprising:

subjecting atomized powders of a nickel-base alloy to a solution treatment;

quenching the solution treated atomized powders so as to develop powders comprising particles having a thermally altered microstructure, wherein the thermally altered microstructure comprises gamma phase, gamma prime phase, gamma double prime phase, or combinations thereof;

introducing a powder feedstock comprising the particles having the thermally altered microstructure into a cold-spray apparatus; and operating the cold-spray apparatus to deposit the feedstock.

2. The method of claim 1, wherein the thermally altered microstructure comprises a matrix, wherein the matrix comprises the gamma-phase.

3. The method of claim 2, wherein the thermally altered microstructure further comprises precipitates of the gamma prime phase, the gamma-double prime phase, or a combination thereof.

4. The method of claim 1, wherein the particles have an average grain size in the range from about 1 μm to 20 μm.

5. The method of claim 1, wherein the feedstock consists essentially of particles comprising at least about 40% nickel by weight.

6. The method of claim 1, further comprising exposing the powder feedstock to a temperature of at least half the melting point of the nickel-base alloy for a duration of at least 5 minutes to produce the thermally altered microstructure.

7. The method of claim 1, wherein operating the cold spray apparatus further comprises introducing a carrier gas comprising nitrogen into the apparatus.

8. The method of claim 7, wherein a carrier gas temperature is in the range from about 20° C. to about 1200° C.

9. The method of claim 1, further comprising heat-treating the deposited feedstock to form a deposit comprising a strengthening precipitate phase distributed within a matrix phase.

10. The method of claim 9, wherein the matrix comprises nickel-base gamma phase and the strengthening precipitate phase comprises gamma prime, gamma-double prime, or combinations thereof.

11. The method of claim 9, wherein the matrix phase has a face-centered cubic crystal structure.

12. The method of claim 9, wherein the precipitate is less than about 80 volume % of the deposit.

13. The method of claim 12, wherein the precipitate is in the range from about 20 volume % to about 55 volume % of the deposit.

14. The method of claim 9, wherein heat-treating the deposited feedstock comprises heating to a temperature in the range from about 300° C. to about 1300° C.

15. The method of claim 1, wherein operating the cold spray device comprises accelerating the feedstock to a velocity in the range from about 500 m/s to about 1100 m/s.

16. An article formed by the method of claim 1.

17. A method comprising:

subjecting atomized powders of a nickel-base alloy to a solution treatment;

quenching the solution treated atomized powders so as to develop powders comprising particles having a thermally altered microstructure, wherein the thermally altered microstructure comprises gamma phase, gamma prime phase, gamma double prime phase, or combinations thereof;

introducing a powder feedstock into a cold-spray apparatus, wherein the feedstock consists essentially of the particles having the thermally altered microstructure; and operating the cold-spray apparatus to deposit the feedstock.

18. The method of claim 17, further comprising heat-treating the deposited feedstock to form a deposit comprising a strengthening precipitate phase distributed within a matrix phase.

19. The method of claim 17, wherein quenching the solution treated atomized powders comprises furnace cooling without an aging step.

20. The method of claim 1, wherein quenching the solution treated atomized powders comprises furnace cooling without an aging step.

* * * * *